US005568943A

United States Patent [19]

Kilström et al.

[11] Patent Number: 5,568,943

[45] Date of Patent: Oct. 29, 1996

[54] TELESCOPIC TUBE CONNECTION FOR A VACUUM CLEANER

[75] Inventors: Lars G. Kilström, Täby; Nils T. Lindquist, Farsta; Lars G. Tuvin, Knivsta, all of Sweden

[73] Assignee: Aktiebolaget Electrolux, Stockholm, Sweden

[21] Appl. No.: 386,634

[22] Filed: Feb. 10, 1995

[30] Foreign Application Priority Data

Mar. 1, 1994 [SE] Sweden ..... 9400702

[51] Int. Cl.[6] ..... F16L 21/00

[52] U.S. Cl. ..... 285/7; 285/119; 285/303

[58] Field of Search ..... 285/7, 119, 303

[56] References Cited

U.S. PATENT DOCUMENTS

| | | | |
|---|---|---|---|
| 3,184,776 | 5/1965 | Vermeulen | 285/7 X |
| 3,314,039 | 4/1967 | Opper | 285/7 X |
| 3,351,363 | 11/1967 | Downey et al. . | |
| 4,018,493 | 4/1977 | Bortholomew et al. | 285/7 X |
| 5,332,266 | 7/1994 | Canale | 287/7 |

FOREIGN PATENT DOCUMENTS

| | | | |
|---|---|---|---|
| 1199445 | 8/1965 | Germany . | |
| 3941767C2 | 9/1991 | Germany . | |
| 919337 | 2/1963 | United Kingdom | 285/7 |

*Primary Examiner*—Dave W. Arola
*Attorney, Agent, or Firm*—Pearne, Gordon, McCoy & Granger

[57] ABSTRACT

A vacuum cleaner having a hose (13) which is connected to a vacuum cleaner housing, the outer end of the hose having a tube handle (12). The tube handle is connected to a nozzle (10) by a tube shaft (11). The tube shaft (11) is movable relative to the tube handle (12), and can be releasably locked in different positions. A device is conveniently provided to allow the operator to adjust the relative length of the tube shaft by moving the tube shaft relative to the tube handle.

14 Claims, 2 Drawing Sheets

TELESCOPIC TUBE CONNECTION FOR A VACUUM CLEANER

BACKGROUND OF THE INVENTION

1. Field of the Invention

The present invention relates to a device for a vacuum cleaner having a hose connected between a vacuum cleaner housing and a tube handle, the tube handle being connected to a nozzle by means of a tube shaft. The present invention also relates to hand-held vacuum cleaner units having a vacuum cleaner housing and an inlet tube, the inlet tube being connected to a nozzle by means of a tube shaft.

2. Description of Related Art

Vacuum cleaners are commonly provided with a hose and a tube handle. In order to adapt the length of the tube shaft to the operator, it is common to use tube shafts comprising an inner tube and an outer tube which can be moved and locked in different positions with respect to each other. Such devices are described, for instance, in EP 293518, 399177, 520534, 552481, 553482 and 537457.

In the last-mentioned specification the telescopically adjustable suction pipe comprises an inner pipe with an axial guide slot having a number of axially-spaced locking notches which receive a locking element that is incorporated into a guide piece fitted in an opening in the other pipe to lie between the inner and outer pipes. The outer pipe has a uniform diameter, the guide piece fitting radially through the opening and being secured against radial movement by a sleeve fitted around the outside of the outer pipe. Preferably, a spring-biased retaining element between the sleeve and the guide piece is displaced via a manual operating element to release the locking element for relative adjustment of the telescopic pipe.

Unfortunately, the devices disclosed in the aforementioned patents are typically difficult to adjust during use because the adjustment mechanism is placed far down on the tube shaft. The location of the adjustment mechanism requires the operator to release his grip about the tube handle and use both hands for moving the inner and outer parts of the tube shaft with respect to each other. Moreover, the known tube shaft arrangements cannot, in a simple manner, be provided with an electric cable or wire which is joined to the shaft and which connects a motor driven nozzle with the electric source of the vacuum cleaner because of the movement between the inner and outer parts of the tube shaft.

Recently, a new type of vacuum cleaner comprising a small hand-held unit has been developed. The hand-held unit comprises a combination of a vacuum source driven by a high speed electric motor and a dust container which is connected directly to a tube shaft. This type of vacuum cleaner is described, for instance, in PCT/SE94/00002 and PCT/SE94/00003.

SUMMARY OF THE INVENTION

An object of the present invention is to provide a simple and inexpensive telescopic device for adjusting the overall or effective length of the tube shaft for the types of vacuum cleaners mentioned above. According to the present invention, the device allows for a comfortable adjustment of the tube shaft length, and the adjustment can be effected during use of the vacuum cleaner without making it necessary for the operator to completely change the grip of the handle or the tube shaft. The arrangement also makes it possible to place an electric cable directly on the tube shaft and, in a simple way, connect the cable to a motor driven nozzle and to another wire or cable secured to the hose.

BRIEF DESCRIPTION OF THE DRAWINGS

An embodiment of the invention will now be described with reference to the accompanying drawings in which.

DETAILED DESCRIPTION OF THE PREFERRED EMBODIMENT

Figure 1:
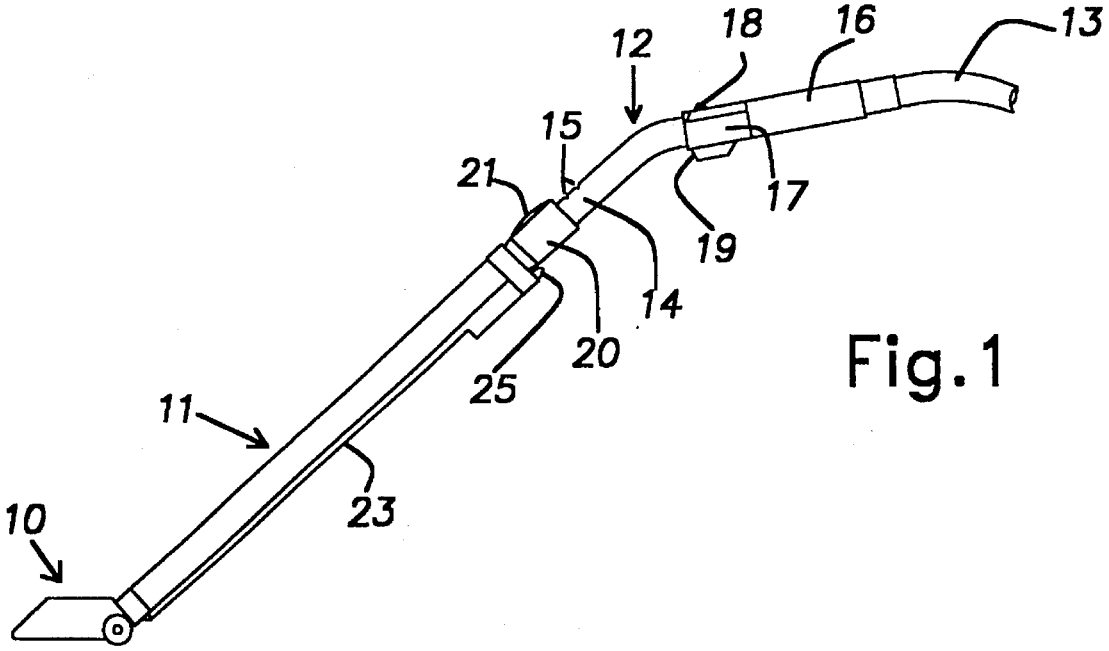
FIG. 1 is a side elevational view of a nozzle, tube shaft, tube handle, and hose of a vacuum cleaner according to the present invention.
Figure 2:
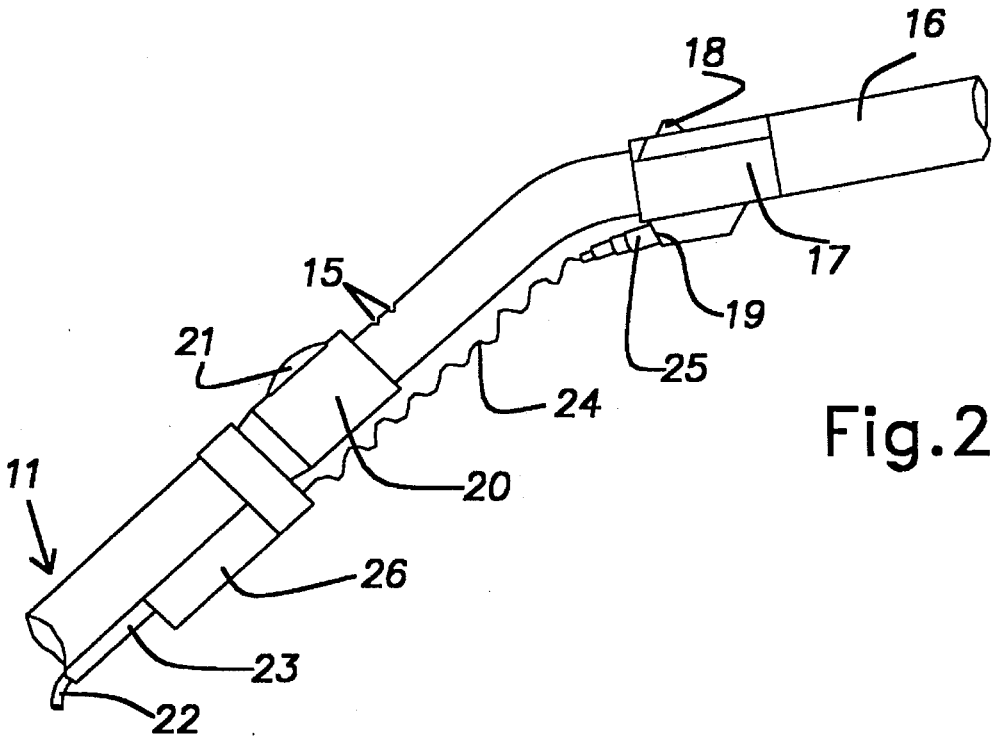
FIG. 2, in a larger scale, shows the connection between the tube shaft of the vacuum cleaner and the tube handle; and, FIG. 3 is a side elevational view of a hand held unit including a tube shaft according to the present invention.

With reference to the drawing figures, a vacuum cleaner nozzle 10, for instance a motor driven nozzle, is shown to be connected, via a tube shaft 11, to a tube handle 12. The tube handle 12 is connected to one end of a hose 13 whose other end is connected to a vacuum cleaner housing (not shown) which includes a dust container and a motor-fan unit.

The tube handle 12 has a front part 14 which is directed obliquely downwards toward the nozzle 10 and which is inserted into the tube shaft 11. The front part 14 has several recesses or notches 15, the purpose of which will be discussed below. A rear part 16 of the tube handle 12 is shaped as a handle whereas an intermediate section 17 has control means 18, if any, for the vacuum cleaner and an electric socket 19. The electric socket 19 is connected to the household electric supply, via an electric cable extending through the handle 16, hose 13, and vacuum cleaner housing.

The tube shaft 11, which has a diameter that is somewhat larger than the diameter of the front part 14 of the tube handle 12, is telescopically slidable on the tube handle 12 and has, at its upper end, a collar-shaped section 20 which contains a locking means 21. The locking means 21 is of conventional type and cooperates with the recesses 15 in such a way that the tube shaft 11 can be fixed in different positions on the tube handle 12, corresponding to the positions of the recesses. The tube shaft 11 also includes an electric cable 22 which is placed in a shell 23 at the outside of the tube shaft. The electric cable at the lower part of the tube shaft 11 may be arranged to automatically be connected to a corresponding cable or electrical fixture on the nozzle 10 when the nozzle is fastened to the tube shaft.

An upper part of the cable 22 is shaped as an elastic coil 24 to which a plug 25 is connected. The plug 25 can be connected to the socket 19, but is normally stored in a holder 26 in the upper part of the tube shaft 11, and the coil 24 is stored in a pocket in the holder 26. It should be mentioned that it is also possible to place the coil 24 at a lower part of the cable and to use an upper linear cable section extending out from the holder 26 when the plug is connected to the socket. In such a case, the pocket 26 in the holder, of course, has to be somewhat extended in the downward direction.

The device is used in the following way. A conventional nozzle 10 or a motor driven nozzle is connected to the lower part of the tube shaft 11 after which the tube handle 12 is inserted into the tube shaft 11 and is fixed in position by means of the locking mechanism 21. If necessary, the plug 25 and coil 24 are pulled out from the holder 26 and connected to the socket 19 on the tube handle 12. When the vacuum cleaner is being used, the operator grasps the handle 16 with one hand, and the upper part of the tube shaft 11 with the other hand. If it is necessary to adjust the length of the tube shaft 11 during use in order to get a comfortable working position, the lower hand is moved slightly up towards the locking means 21 and activates it so that the tube shaft 11 can be telescopically moved relative to the tube handle 12 thereby maintaining the grip of the upper hand. If the plug 25 is connected to the socket 19, the electric cable 22 during this telescopic movement 22, is still connected to the vacuum cleaner housing because of the flexibility of the coil 24. Thus, the adjustment is very easy to do.

Figure 3:
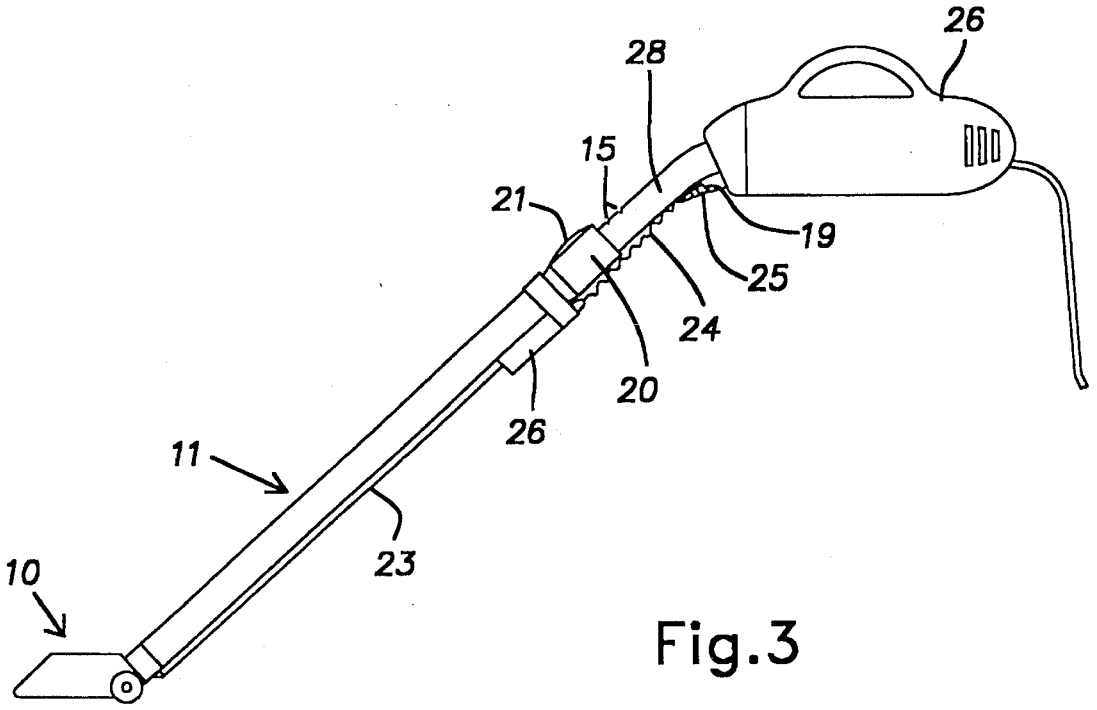

FIG. 3 shows an arrangement wherein the tube handle is replaced by a hand-held unit 26 comprising a vacuum source driven by a high speed electric motor (not shown), and a dust container (not shown). The unit is, via an electric cable 27, connected to the main electric supply and has at its front end an inlet tube 28 directing the air-dust flow into the dust container. The inlet tube is provided with recesses or notches 15 and is connected to the tube shaft 11 in the same manner as has been described above with respect to the tube handle.

By means of the suggested arrangement, the advantage is also achieved that the tube shaft 11, even if it has a fixed shape which allows an electric cable in a simple way to be arranged outside the tube shaft 11, together with the tube handle 12, offers a possibility to adjust the distance between the nozzle and the handle.

It should be observed that it is within the scope of the invention to invert the arrangement, i.e., to place the locking means on the tube shaft 11 and to let the tube shaft 11 move within the tube handle 12 as well as it is possible to use other types of locking mechanisms such as, for instance, mechanisms wherein locking is achieved by turning a part of the tube shaft or the tube handle.

It is also possible within the scope of the invention to integrate the vacuum cleaner housing and the tube handle to a hand-held unit with an inlet tube which corresponds to the front part 14 of the tube handle 12 of this unit in a corresponding way being movable with respect to the tube shaft.

Therefore, it is respectfully submitted that the present invention is not limited to the specific and preferred embodiment described above, but rather shall cover and include any and all modifications, rearrangements and substitutions of parts which fall within the purview of the invention as defined in the claims appended hereto.

What is claimed is:

1. A device for a vacuum cleaner which comprises a hose (13), a tube handle (12), and a tube shaft (11), said hose having a first end connected to a vacuum cleaner housing and a second end connected directly to a first end of said tube handle (12), said tube handle having a second end directly connected to a first end of said tube shaft (11), said tube shaft having a second end which is secured to a nozzle, wherein the first end of the tube shaft (11) is movably connected to the second end of the tube handle (12) and can be locked in different positions with respect to said tube handle, said tube handle and said tube shaft cooperating to define means for releasably retaining said tube handle in any one of said different positions relative to said tube shaft.

2. A device according to claim 1, wherein said means includes one of the tube handle (12) and the tube shaft (11) provided with several recesses (15) which cooperate with a locking means arranged on the other of the tube shaft (11) and tube handle (12).

3. A device according to claim 1, wherein an electric cable (22) is fixed to the tube shaft (11) and a socket (19) is arranged on the tube handle, an upper end of the cable being provided with a plug (25) for connection to said socket (19), said electric cable being constructed to extend between said tube shaft and said tube handle in any one of said different positions.

4. A device according to claim 3, wherein the electric cable (22) is provided with a coil shaped part (24) to permit extension of said electric cable.

5. A device according to claim 3, wherein the electric cable (22) is placed outside the tube shaft (11).

6. A device according to claim 3, wherein the tube shaft includes a holder and the upper end of the electric cable (22) is placed in said holder (26).

7. A device according to claim 6, wherein the electric cable (22) is provided with a coil shaped part to permit extension of said electrical cable and the holder (26) is provided with a pocket in which the coil shaped part (24) of the electric cable is stored.

8. A device for a hand-held vacuum cleaner, comprising a vacuum cleaner housing, an inlet tube extending from said housing, and a tube shaft, said inlet tube having an end remote from said vacuum cleaner housing which is directly connected to said tube shaft, said tube shaft extending between said inlet tube and a nozzle, wherein the tube shaft is movable relative to the inlet tube and can be locked in several different positions with respect to said inlet tube, said inlet tube and tube shaft cooperating to define means for releasably retaining said tube shaft in any one of said several different positions relative to said inlet tube.

9. A device according to claim 8, wherein said means includes one of the inlet tube and the tube shaft provided with several recesses which cooperate with a locking means arranged on the other of the tube shaft and inlet tube.

10. A device according to claim 8, wherein an electric cable is fixed to the tube shaft and a socket is arranged on the inlet tube, an upper end of the cable being provided with a plug for connection to said socket, said electric cable being constructed to extend between said tube shaft and said inlet tube in any one of said several different positions.

11. A device according to claim 10, wherein the electric cable (22) is placed outside the tube shaft (11).

12. A device according to claim 10, wherein the electric cable (22) is provided with a coil shaped part (24) to permit extension of said electric cable.

13. A device according to claim 12, wherein the tube shaft includes a holder (26) and the upper end of the electric cable (22) is placed in said holder (26).

14. A device according to claim 13, wherein the electric cable (22) is provided with a coil shaped part to permit extension of said electrical cable and the holder (26) is provided with a pocket in which the coil shaped part (24) of the electric cable is stored.

* * * * *